US010206483B2

(12) United States Patent
Gajjar

(10) Patent No.: US 10,206,483 B2
(45) Date of Patent: Feb. 19, 2019

(54) MINIATURE COSMETIC CASE

(71) Applicant: Minis For Me, LLC, Scottsdale, AZ (US)

(72) Inventor: Reena Gajjar, Scottsdale, AZ (US)

( * ) Notice: Subject to any disclaimer, the term of this patent is extended or adjusted under 35 U.S.C. 154(b) by 247 days.

(21) Appl. No.: 15/277,003

(22) Filed: Sep. 27, 2016

(65) Prior Publication Data

US 2017/0095059 A1 Apr. 6, 2017

Related U.S. Application Data

(60) Provisional application No. 62/237,684, filed on Oct. 6, 2015.

(51) Int. Cl.

| | |
|---|---|
| ***A45D 33/28*** | (2006.01) |
| ***A45D 40/24*** | (2006.01) |
| ***A45D 40/22*** | (2006.01) |
| ***A45D 42/02*** | (2006.01) |

(52) U.S. Cl.

CPC ..... *A45D 40/24* (2013.01); *A45D 40/22* (2013.01); *A45D 42/02* (2013.01)

(58) Field of Classification Search

CPC ..... A45D 40/24; A45D 40/22; A45D 42/02; A45D 33/28; A45D 2034/005; A45D 34/06; Y10T 206/813; B65D 21/0201; B65D 21/0233

USPC ..... 132/297, 294, 295, 296, 314, 315, 317, 132/318

See application file for complete search history.

(56) References Cited

U.S. PATENT DOCUMENTS

| | | | | |
|---|---|---|---|---|
| 2,010,521 A * | 8/1935 | Kreisler | A45D 33/006 | 132/297 |
| 3,132,652 A * | 5/1964 | Gazdik | A45D 33/28 | 132/297 |
| 4,562,923 A * | 1/1986 | Katada | A45D 40/24 | 132/314 |
| 4,666,043 A * | 5/1987 | Tahara | A45D 40/10 | 132/318 |
| 4,858,765 A * | 8/1989 | Nakamura | A45D 40/22 | 206/581 |
| 5,005,697 A * | 4/1991 | Jimbo | A45C 13/02 | 132/294 |
| 5,301,808 A * | 4/1994 | Pierson | A45D 40/24 | 132/297 |
| 5,318,053 A * | 6/1994 | Barnhart | A45C 11/008 | 132/297 |

(Continued)

*Primary Examiner* — Nicholas Lucchesi
(74) *Attorney, Agent, or Firm* — Dale J. Ream

(57) ABSTRACT

A cosmetic case according to the present invention for selectively receiving miniature cosmetic items includes a lower case portion having a bottom wall and a continuous side wall extending upwardly from a perimeter edge of the bottom wall, the lower case having an open top and defining an interior area. The cosmetic case includes an upper case portion pivotally coupled to a rear section of the side wall of the lower case portion and being selectively movable between open and closed configurations. A front section of the side wall defines a plurality of apertures configured to selectively receive the tubular cosmetic items into the interior area. The cosmetic case includes a spring loaded assembly configured to naturally urge the cosmetic items out of the interior area. A magnetic shelf in the lower case portion configured to support magnetic cosmetic receptacles.

9 Claims, 9 Drawing Sheets

(56) References Cited

U.S. PATENT DOCUMENTS

| | | | | |
|---|---|---|---|---|
| 5,687,849 | A * | 11/1997 | Borenstein | F16L 3/227 206/443 |
| 6,532,970 | B2 * | 3/2003 | Phue | A45C 1/04 132/293 |
| 6,708,846 | B1 * | 3/2004 | Fuchs | A61M 11/06 222/82 |
| 6,796,431 | B1 * | 9/2004 | Goldring | A45D 33/006 132/297 |
| 6,886,695 | B1 * | 5/2005 | Karoly | A45D 40/24 206/581 |
| 8,113,350 | B2 * | 2/2012 | Sanchez | A45D 40/00 132/297 |
| 8,770,209 | B2 * | 7/2014 | Kim | A45D 33/26 132/297 |
| 9,474,349 | B2 * | 10/2016 | Holloway | A45D 40/06 |
| 9,743,750 | B2 * | 8/2017 | Boyke | A46B 11/001 |
| 2002/0027113 | A1 * | 3/2002 | Lacout | A47F 7/286 211/60.1 |
| 2002/0117422 | A1 * | 8/2002 | Karoly | A45D 40/24 206/581 |
| 2005/0081877 | A1 * | 4/2005 | Byun | A45C 11/34 132/294 |
| 2005/0109660 | A1 * | 5/2005 | Karoly | A45D 40/24 206/538 |
| 2005/0161365 | A1 * | 7/2005 | Karoly | A45D 40/24 206/538 |
| 2014/0299151 | A1 * | 10/2014 | Stroud | A45D 33/008 132/315 |
| 2016/0135567 | A1 * | 5/2016 | Kamboj | A45D 34/00 132/314 |
| 2016/0249729 | A1 * | 9/2016 | Hermouet | A45D 40/065 401/68 |
| 2016/0324297 | A1 * | 11/2016 | Moore | A45D 40/24 |

* cited by examiner

MINIATURE COSMETIC CASE

REFERENCE TO RELATED APPLICATIONS

This application claims the benefit of Provisional patent application No. 62/237,684, filed Oct. 6, 2015 entitled Miniature Cosmetic Case which is incorporated herein in its entirety.

BACKGROUND OF THE INVENTION

This invention relates generally to cosmetics and cosmetic accessories and, more particularly, to a cosmetic case that is carried easily by a woman and which enables her to have access to miniature size cosmetics.

Makeup is traditionally provided in larger sizes and containers. However, a user may not need such a large quantity of selected makeup. The cost of current high quality makeup is Relatively high and it can be cost prohibitive for women to have multiple colors and products, especially to take them with her while traveling, going to work, or the like. Further, the makeup may expire prior to the time that the user is able to use all of the makeup. In addition, a compact and easily carried case for carrying miniature makeup packages has not been proposed or marketed.

Therefore, there is a long-felt need for a makeup container or case that provides smaller samples of makeup that is easily replaceable. It would be desirable to have a cosmetic carrier uniquely configured to receive and contain miniature packages of cosmetic products. Further, it would be desirable to have a cosmetic case having spring loaded assemblies normally configured to release cosmetic products yet configured to retain them if selected.

SUMMARY OF THE INVENTION

A cosmetic case according to the present invention for selectively receiving miniature cosmetic items includes a lower case portion having a bottom wall and a continuous side wall extending upwardly from a perimeter edge of the bottom wall, the lower case having an open top and defining an interior area. The cosmetic case includes an upper case portion pivotally coupled to a rear section of the side wall of the lower case portion and being selectively movable between open and closed configurations. A front section of the side wall defines a plurality of apertures configured to selectively receive the tubular cosmetic items into the interior area. The cosmetic case includes a spring loaded assembly configured to naturally urge the cosmetic items out of the interior area. A magnetic shelf in the lower case portion configured to support magnetic cosmetic receptacles.

Therefore, a general object of this invention is to provide a cosmetic case configured to selectively retain miniature forms of cosmetic products for easy transport, storage, replacement, and use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
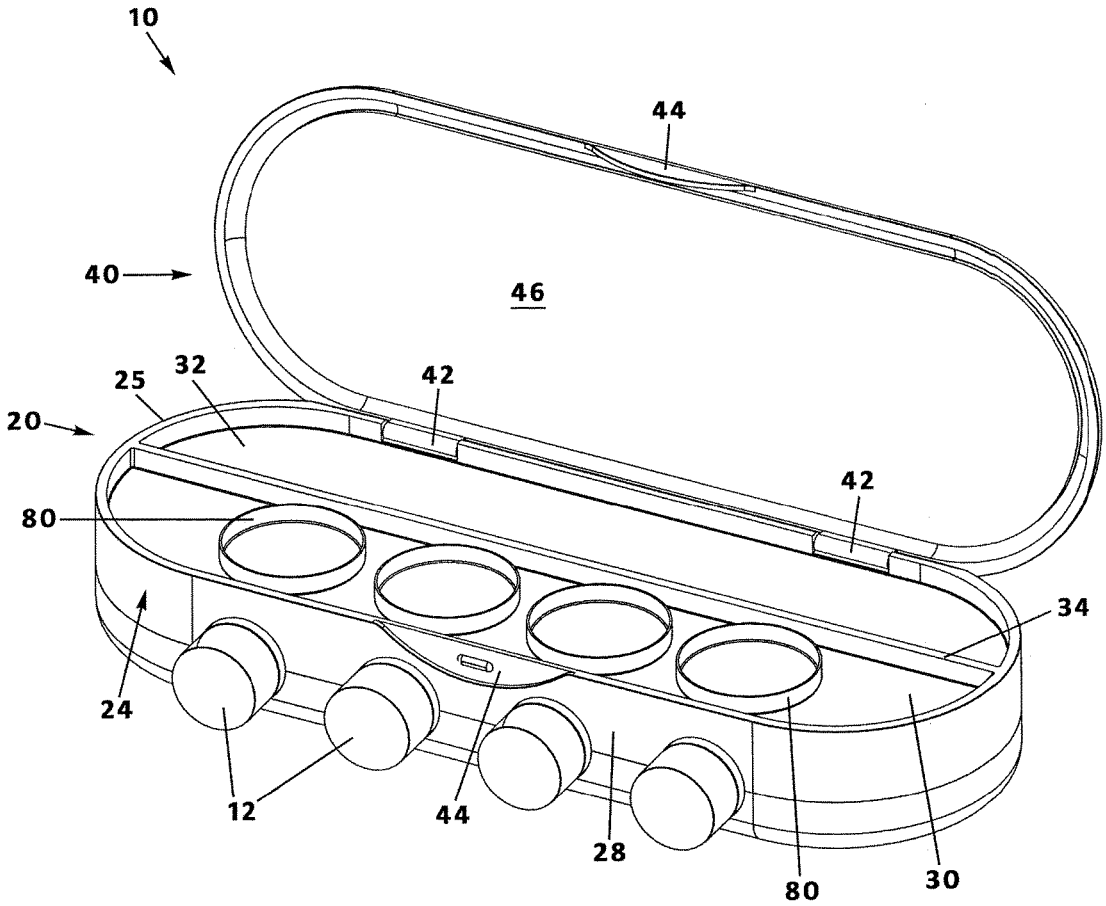
FIG. 1 is a perspective view of a cosmetic case according to a preferred embodiment of the present invention, illustrated in an open configuration.

A cosmetic case according to a preferred embodiment of the present invention will now be described with reference to FIGS. 1 to 7*e* of the accompanying drawings. The cosmetic case 10 includes a lower case portion 20, an upper case portion 40, a spring loaded assembly 50, and a plurality of magnetic containers 80.

The cosmetic case 10 includes an upper case portion 40 pivotally coupled to a lower case portion 20 so that cosmetic items stored therein are protected and portable. Preferably, the cosmetic case 10 is dimensioned to be carried easily in a woman's purse, the pocket of a jacket, a briefcase, or even carried by hand.

The lower case portion 20 includes a bottom wall 22 and has, in an embodiment, a continuous side wall 24 extending upwardly from a perimeter or peripheral edge thereof. As shown in the accompanying illustrations, the case may have a generally rectangular configuration with rounded corners such that the side wall 24 is unbroken by corners. It is understood, however, that the case may have other similar configurations, such as a traditional rectangle with parallel front and rear walls connected by side or end walls (not shown). In the illustrated embodiment, the side wall 24 may include a rear section 26 and a front section 28 parallel and opposite the rear section 26. The side wall 24 includes an upper or top edge 25 that defines an open top, the lower case portion 20 defining an interior space configured to contain structures and components that will be further described below. As illustrated—particularly in FIG. 3—the lower case portion 20 may include an upper section and a lower section that cooperate to form the structures and functions described herein as well as to facilitate maintenance and repair of internal components; however, a singular or unitary construction is also possible.

Figure 2:
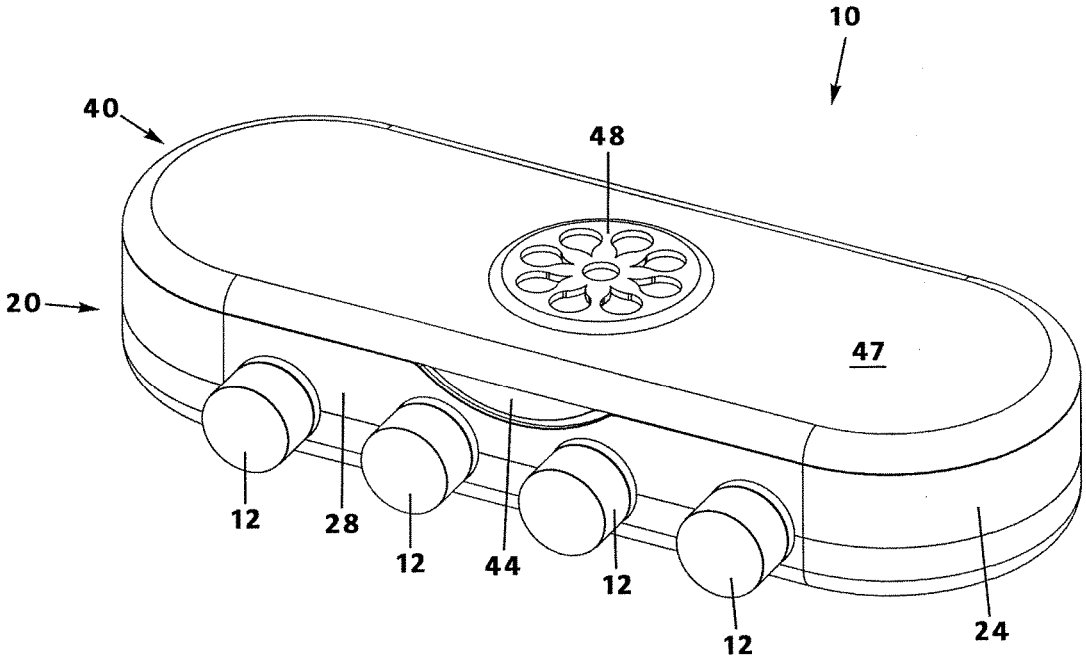
FIG. 2 is a perspective view of the cosmetic case as in FIG. 1, illustrated in a closed configuration.
Figure 3:
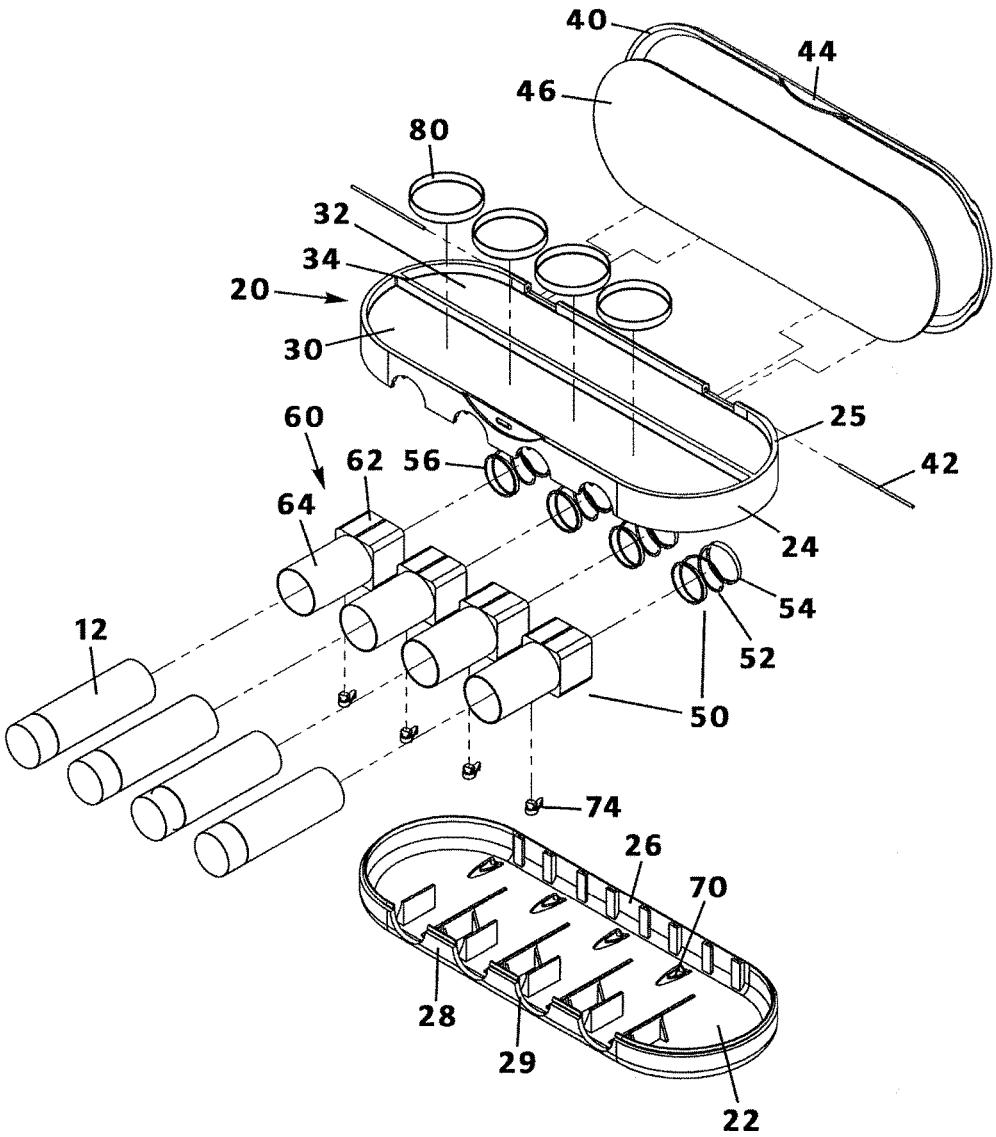
FIG. 3 is an exploded view of the cosmetic case as in FIG. 1.
Figure 4:
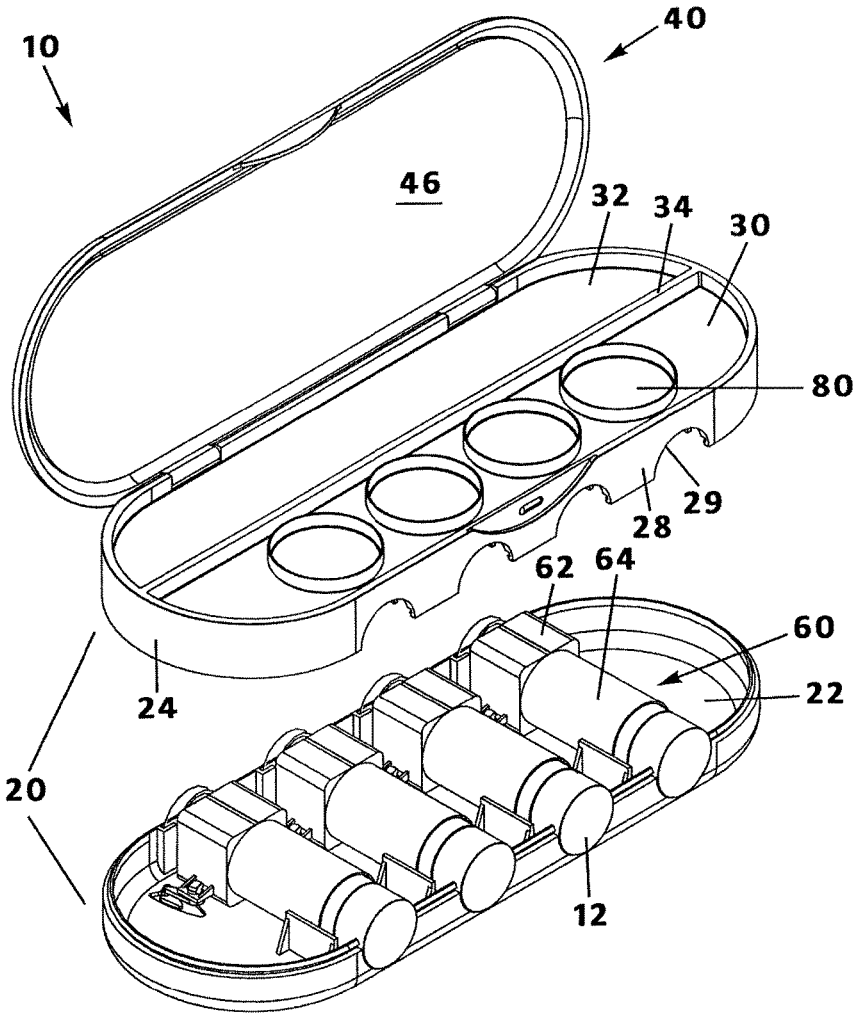
FIG. 4 is a partially exploded view of the cosmetic case as in FIG. 1.
Figure 5A:
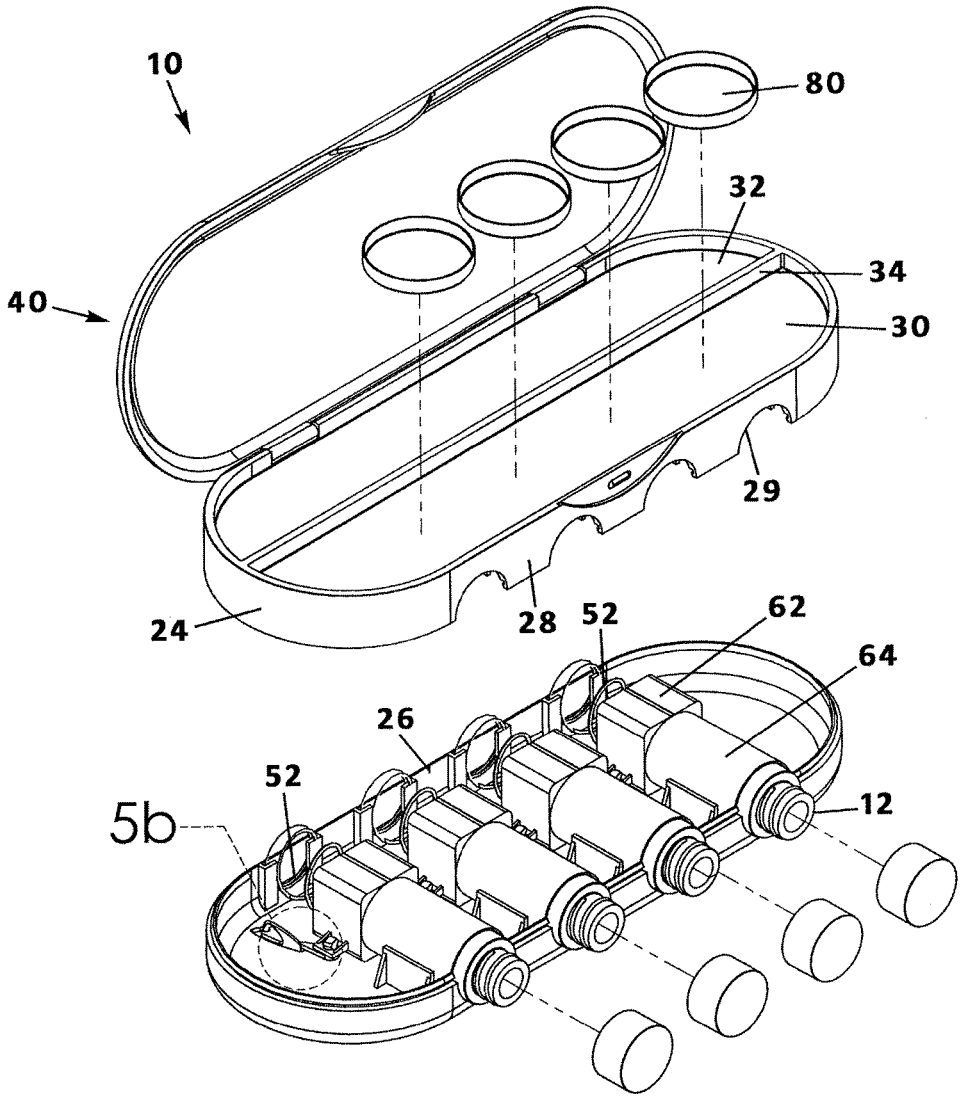
FIG. 5*a* is another partially exploded view of the cosmetic case as in FIG. 4.
Figure 5B:
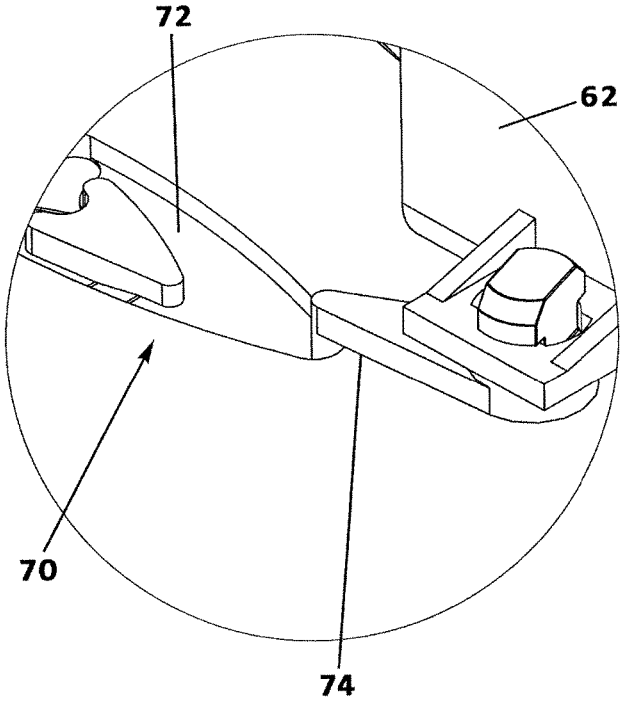
FIG. 5*b* is an isolated view on an enlarged scale taken from FIG. 5*a;*

One edge of the upper case portion 40 is pivotally coupled to the upper edge 25 of the rear section 26 of the side wall 24 of the lower case portion 20, such as with hinges 42. Therefore, the upper case portion 40 is selectively movable between an open configuration allowing access to the interior area of the lower case portion (FIG. 1) and a closed configuration not allowing access to the lower case portion 20 (FIG. 2). The upper case portion 40 may be releasably coupled to the lower case portion 20 with a fastener 44 such as a latch, clasp, snap, button, hook and loop combination, or just a corresponding friction fit engagement.

The upper case portion 40 includes an inner surface. A mirror 46 is coupled to the inner surface and is configured to cover all or part of the surface. Accordingly, a user is able to view herself when the upper case portion 40 is moved to the open configuration, such as when makeup is or has been applied to her eyes, lips, or the like. The upper case portion 40 includes an outer surface 47 which may include indicia 48 indicative of a brand, an organization, personal identification, or other promotional matter.

The front section 28 (i.e. front wall) of the side wall 24 of the lower case portion 20 may define a plurality of apertures 29 spaced apart laterally therealong, each aperture 29 defining an opening giving access to the interior area of the lower case portion 20. In an embodiment illustrated in the accompanying drawings, the apertures 29 have a circular opening specifically configured to receive miniaturized tubular containers of cosmetics such as lipstick, mascara, or the like. However, other configurations are possible to receive cosmetics having coordinated packaging having other shape configurations. Guide members may be positioned within the interior area to direct incoming cosmetic items 12 and the receiving members, as will be described later.

Figure 6A:
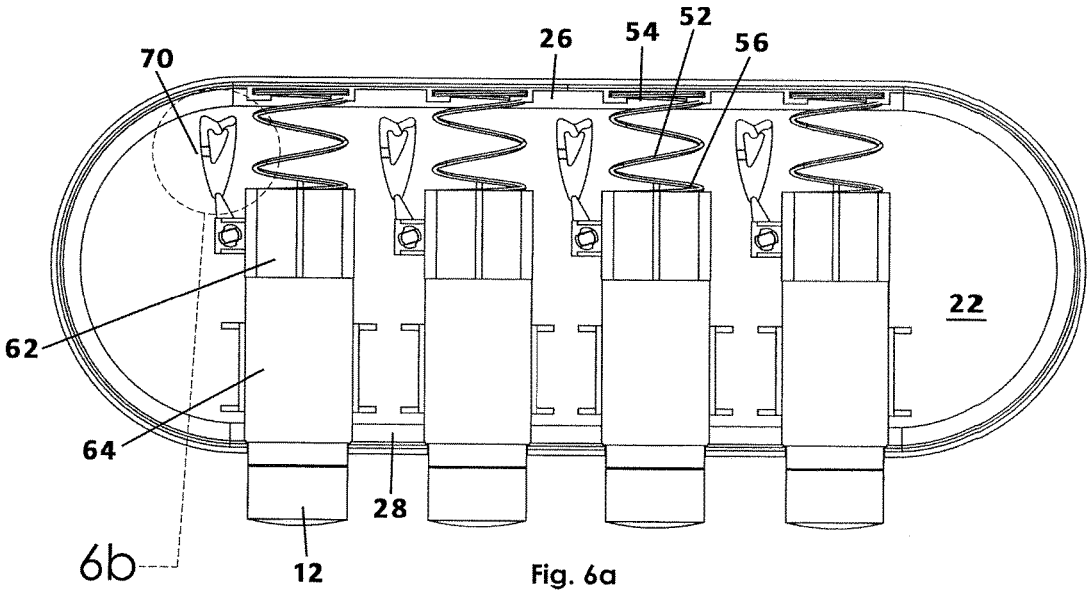
FIG. 6*a* is a top view of a lower section of the lower case portion of the cosmetic case as in FIG. 5*a;*
Figure 6B:
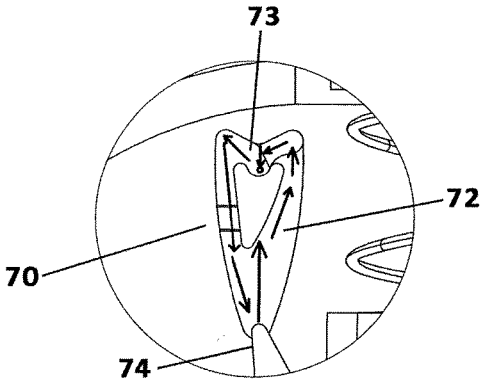
FIG. 6*b* is an isolated view on an enlarged scale taken from FIG. 6*a;*

The cosmetic case 10 includes a plurality of spring loaded assemblies 50 positioned in said interior area of the lower case portion 20. Each spring loaded assembly 50 is configured to receive a tubular cosmetic item 12 and is normally biased to urge the tubular cosmetic item 12 out of the interior space through a respective aperture 29. More particularly, each spring loaded assembly 50 includes a compression spring 52 having a first end 54 coupled to an inner surface of the rear section 26 of the continuous side wall 24 of the lower case portion 20, the spring 52 being normally biased toward a released or expanded configuration extending away from the rear section 26 (FIG. 6*a*).

Each spring loaded assembly 50 also includes a receiving member 60 having a base 62 operatively coupled to a second end 56 (opposed to the first end 54) of an associated compression spring 52. Each receiving member 60 also includes a tubular receptacle 64 defining an open end that provides access into an interior space, the receptacle 64 being configured to selectively receive a tubular makeup item therein. The tubular receptacle 64 is movable in and out through a respective aperture 29 (FIG. 1). For instance, a tubular makeup item 12 may be slidably inserted into the interior space of a respective tubular receptacle 64. In use, a respective receiving member 60 may be urged (pushed) inwardly through a respective aperture 29 into the interior area of the lower case portion 20. In doing so, the base 62 is in operative contact with the second end 56 of the compression spring 52 so as to move the spring 52 toward its compressed configuration.

When a spring loaded assembly 50 is first urged inwardly, the spring 52 becomes compressed. A release of the inward force causes the receiving member 60 to enter a stationary or locked configuration in which the spring 52 is not allowed to move to the released configuration. A further inward pressure on the receiving member 60 causes the spring 52 to be released from the locked configuration and to move toward its decompressed configuration.

Now more specifically, the spring loaded assembly 50 further includes a cam guide track 70 positioned proximate an associated compression spring 52, said cam guide track 70 defining a cam profile 72 that directs movement the receiving member 60 (FIG. 6*b*) as will be described below. Each spring loaded assembly 50 also includes a follower pin 74 coupled to a respective receiving member 60 (such as being attached to a respective base 62), the follower pin 74 being configured to engage with the cam guide track 70 as the receiving member 60 is manipulated to move the compression spring 52 between compressed and released configurations.

Figure 7A:
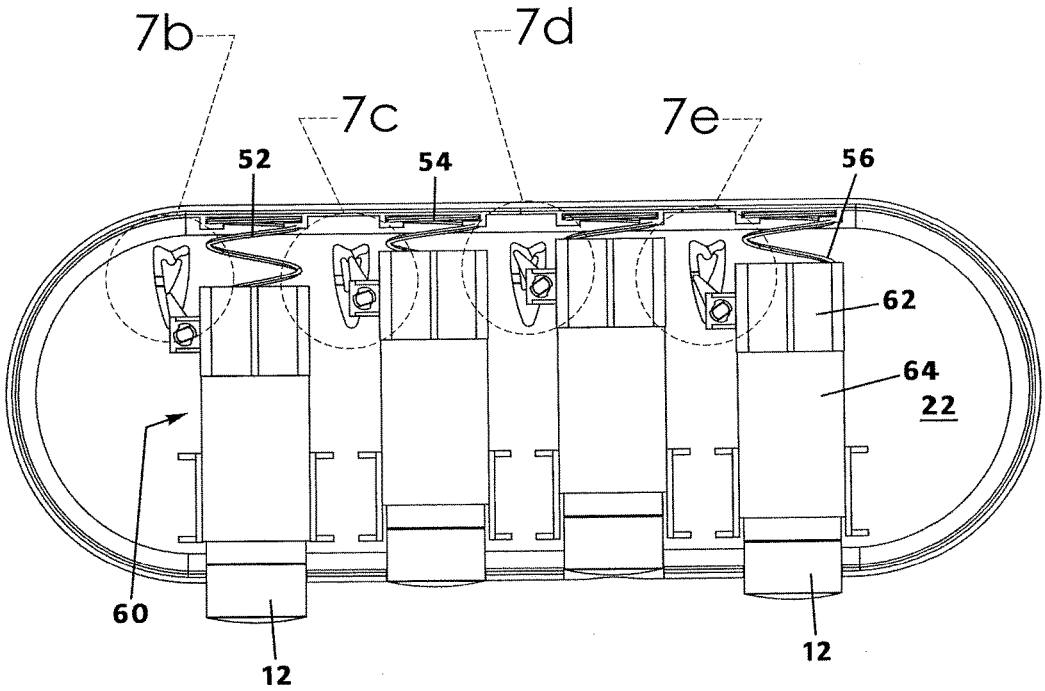
FIG. 7*a* is another top view of a lower section of the lower case portion of the cosmetic case as in FIG. 6*a;*
Figure 7B:
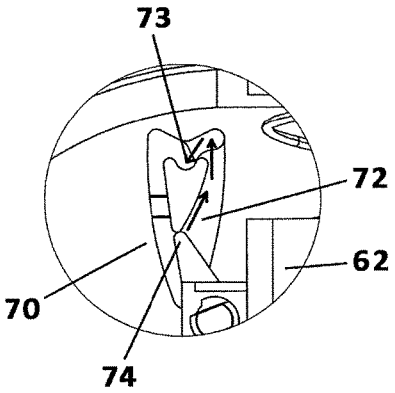
FIG. 7*b* is an isolated view on an enlarged scale taken from FIG. 7*a;*
Figure 7C:
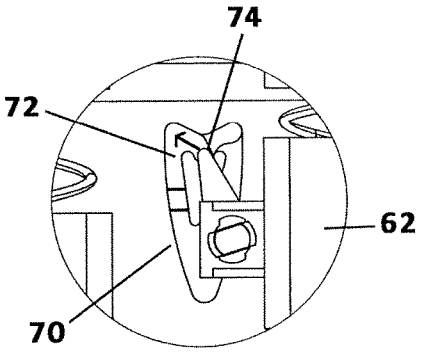
FIG. 7*c* is an isolated view on an enlarged scale taken from FIG. 7*a;*

As shown in FIGS. 7*a* to 7*e*, successive inward movements of the receiving member 60 cause the follower pin 74 to course its way along the cam profile 72. When the receiving member 60 is initially pushed into the interior area (such as by inserting a tubular cosmetic item 12 into a respective tubular receptacle 64), the compression spring 52 is still attempting to bias outwardly the receiving member 60 (FIG. 7*a*) and the follower pin 74 begins its journey along the cam profile 72 (FIG. 7*b*). Then, the inward pressure on the receiving member 60 may be slightly relaxed so that the follower pin 74 follows the cam profile 72 and drops into a recess 73, also referred to as nesting in a locking position (FIG. 7*c*). In the locking position, the spring 52 is prevented from decompressing and outwardly biasing the receiving member 60.

Figure 7D:
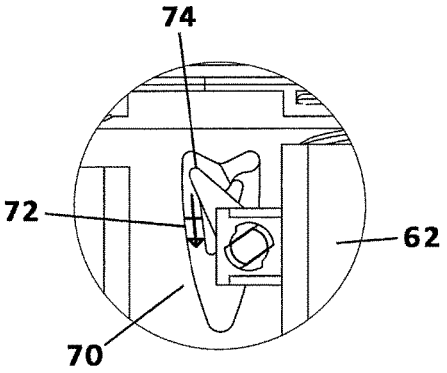
FIG. 7*d* is an isolated view on an enlarged scale taken from FIG. 7*a*.
Figure 7E:
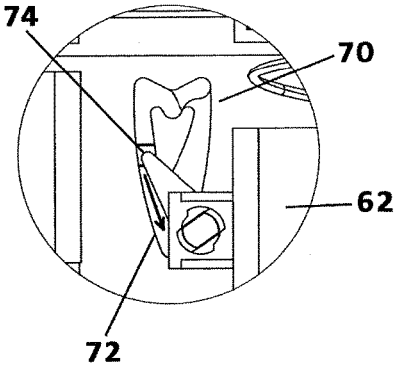
FIG. 7*e* is an isolated view on an enlarged scale taken from FIG. 7*a*.

From the locking position, a further inward pressure on the receiving member 60 causes a complete depression of the compression spring 52 (FIG. 7*a*) and the follower pin 74 is directed out of the recess 73 as shown in FIG. 7*d*. Finally, the inward pressure on the receiving member 60 may again be relaxed allowing the follower pin 74 to be urged outwardly along the cam profile 72 by the decompression or expansion of the compression spring 52 to its released configuration (FIG. 7*e*).

The lower case portion 20 may include one or more shelf portions configured to hold or support makeup devices in the interior area of the case. More particularly, a first shelf portion 30 having a planar configuration may be positioned proximate the open top of the lower case portion 20 and generally adjacent the front section 28 (i.e. front wall). The first shelf portion 30 may be coupled to the side wall 24 or include other structures that displace the first shelf portion 30 above the bottom wall 22. The first shelf portion 30 has a planar configuration capable of supporting one or more makeup containers 80, also referred to as makeup "pots." The makeup containers 80 may be spaced apart along the first shelf portion 30, each container 80 being configured to hold makeup especially of the powder type. In an embodiment, either the first shelf portion 30 or the containers 80 may have a metallic construction while the other has a magnetic construction. Thus, the containers 80 may be secured against undesirable movement but, at the same time, easily removable for refilling or replacement.

The lower case portion 20 may include a second shelf portion 32 proximate the open top, displaced from and parallel to the bottom wall 22, and adjacent the rear section 26 of the continuous side wall 24. In an embodiment, the first and second shelves may be separated by a partition 34 or divider wall. It is noted that both the first and second shelf portions are slightly recessed or displaced from the open top of the lower case portion 20 so as to be peripherally bounded by the side wall 24 just enough to securely contain contents thereon and prevent them from shifting or falling out. The second shelf portion 32 is particularly suited for holding loose makeup accessories such as eye liner pencils, mascara brushes, hair accessories, and the like.

It is desirable and understood that it is preferable to utilize a product line of uniformly sized "miniature cosmetics" with the cosmetic case. For instance, tubular cosmetic items 12 containing cosmetics such as lipstick, lip gloss, mascara, and the like are sized for easy insertion or removal relative to the open space of the lower case portion via the apertures 29 as described above. Powder form cosmetics, such as eye shadow, blush, and the like, are conveniently stored and used from the containers 80 described above.

In some embodiments (not shown), the cosmetic case 10 may have security features. For example, the case may include locks or latches. Moreover, access to compartments may require a scan of a biometric and/or entry of a code in order to unlock the compartment or gain access. The cosmetic case 10 may include sensors that communicate to other devices (e.g., a smart phone) to indicate when a cosmetic is low or empty. The smart phone may include software to notify the user when the user is near a cosmetic store and provide a "shopping list" of the items that need to be replenished.

In use, the cosmetic case 10, in its closed configuration, may be carried easily in a purse, briefcase, jacket pocket, or just carried as one would carry a mobile phone or tablet. When use of the cosmetics is desired, the cosmetic case 10 is moved to its open configuration and desired cosmetics, brushes, etc. are access as described above.

It is understood that while certain forms of this invention have been illustrated and described, it is not limited thereto except insofar as such limitations are included in the following claims and allowable functional equivalents thereof.

The invention claimed is:

1. A cosmetic case configured to selectively receive tubular cosmetic items, comprising:

a lower case portion having a bottom wall and a continuous side wall extending upwardly from a perimeter edge of said bottom wall, said lower case portion having an open top and defining an interior area;

an upper case portion pivotally coupled to a rear section of said side wall of said lower case portion and being selectively movable between open and closed configurations;

wherein a front section of said side wall defines a plurality of apertures configured to selectively receive the tubular cosmetic items into said interior area;

a plurality of spring loaded assemblies positioned adjacent an inner surface of said rear section of said side wall, each spring loaded assembly being normally biased to urge the tubular cosmetic items outwardly through said plurality of apertures, respectively;

wherein each spring-loaded assembly includes:

a compression spring having a first end coupled to said rear section of said side wall and normally biased toward a released configuration extending away from said rear section;

a receiving member having a base operatively coupled to a second end of said compression spring and a receptacle defining an open end and a hollow interior space configured to selectively receive a makeup item therein, wherein said base is configured to urge said compression spring to a compressed configuration tightly adjacent said rear section of said side wall when said receiving member is urged inwardly through a respective aperture;

wherein said each spring-loaded assembly includes:

a cam guide track proximate an associated compression spring and defining a cam profile;

a follower pin coupled to an associated receiving member and configured to engage said cam guide track when said spring-loaded assembly is moved between said compressed and released configurations.

2. The cosmetic case as in claim 1, wherein:

said cam profile includes a locking position that, when engaged by said follower pin, prevents said compression spring from movement toward said released configuration;

said cam profile includes a releasing position that, when engaged by said follower pin, allows said compression spring to move toward said released configuration.

3. The cosmetic case as in claim 2, further comprising a mirror positioned on an inner surface of said upper case portion.

4. The cosmetic case as in claim 2, further comprising:

a first shelf proximate said open top of said lower case portion that is parallel to said bottom wall, said first shelf being adjacent said front section of said side wall and having a planar configuration;

a plurality of containers spaced apart along said first shelf, each container being selectively supported atop said first shelf and selectively removable from said first shelf.

5. The cosmetic case as in claim 1, wherein said upper case portion is pivotally movable between said closed configuration preventing access to said interior area and said open configuration allowing access to said interior area.

6. The cosmetic case as in claim 5, wherein said upper case portion is selectively coupled to said lower case portion with a fastener taken from a group consisting of a latch, clasp, snap, button, hook and loop combination, and friction fit engagement.

7. The cosmetic case as in claim 1, further comprising a mirror positioned on an inner surface of said upper case portion.

8. A cosmetic case configured to selectively receive tubular cosmetic items, comprising:

a lower case portion having a bottom wall and a continuous side wall extending upwardly from a perimeter edge of said bottom wall, said lower case portion having an open top and defining an interior area;

an upper case portion pivotally coupled to a rear section of said side wall of said lower case portion and being selectively movable between open and closed configurations;

wherein a front section of said side wall defines a plurality of apertures configured to selectively receive the tubular cosmetic items into said interior area;

a first shelf proximate said open top of said lower case portion that is parallel to said bottom wall, said first shelf being adjacent said front section of said side wall and having a planar configuration; and a plurality of containers spaced apart along said first shelf, each container being selectively supported atop said first shelf and selectively removable from said first shelf;

wherein said first shelf is one of a metallic construction or magnetic;

wherein said plurality of containers are another of a metallic construction or magnetic such that said plurality of containers and said first shelf are selectively and removably coupled together.

9. The cosmetic case as in claim 8, further comprising a second shelf proximate said open top of said lower case portion that is parallel to said bottom wall, said second shelf being adjacent said rear section of said side wall and having a planar configuration.

* * * * *